United States Patent [19]

Buntaine et al.

[11] Patent Number: 5,013,641

[45] Date of Patent: May 7, 1991

[54] FORMATION OF TABULAR SILVER HALIDE EMULSIONS UTILIZING HIGH PH DIGESTION

[75] Inventors: James R. Buntaine; Robert V. Brady, both of Rochester, N.Y.

[73] Assignee: Eastman Kodak Company, Rochester, N.Y.

[21] Appl. No.: 452,487

[22] Filed: Dec. 19, 1989

[51] Int. Cl.[5] ..... G03C 1/005

[52] U.S. Cl. ..... 430/569; 430/567

[58] Field of Search ..... 430/567, 569

[56] References Cited

U.S. PATENT DOCUMENTS

| | | | |
|---|---|---|---|
| 2,222,264 | 11/1940 | Nietz et al. | 430/603 |
| 2,614,930 | 10/1952 | Lowe et al. | 430/628 |
| 2,772,165 | 11/1956 | Moede | 430/628 |
| 3,153,594 | 10/1964 | Oberth | 430/628 |
| 3,482,982 | 12/1969 | Miyata et al. | 430/569 |
| 3,501,309 | 3/1970 | Gilman et al. | 430/567 |
| 3,637,391 | 1/1972 | Saleck et al. | 430/569 |
| 4,221,863 | 9/1980 | Overman et al. | 430/567 |
| 4,386,156 | 5/1983 | Mignot | 430/567 |
| 4,400,463 | 8/1983 | Maskasky | 430/434 |
| 4,450,225 | 5/1984 | Weyde et al. | 430/567 |
| 4,474,872 | 10/1984 | Onishi et al. | 430/512 |
| 4,713,320 | 12/1987 | Maskasky | 430/567 |
| 4,722,886 | 2/1988 | Nottorf | 430/569 |
| 4,755,456 | 7/1988 | Sugimoto | 430/569 |
| 4,797,354 | 1/1989 | Saitou et al. | 430/567 |

OTHER PUBLICATIONS

Cohen et al., Advances in Physics and Chemistry Series 144 (1974), pp. 198–217.

*Primary Examiner*—Charles L. Bowers, Jr.
*Assistant Examiner*—Janet C. Baxter
*Attorney, Agent, or Firm*—Paul A. Leipold

[57] ABSTRACT

The invention is generally accomplished by providing a tabular silver halide emulsion formation process in which the pH is controlled to greater than 9 by the addition of an alkali base prior to digesting to form uniform nucleated silver bromide particles. In a particularly preferred process the emulsion is adjusted to a pH greater than 9 by the use of sodium hydroxide, digestion takes place in between 3 and 7 minutes, and the emulsion making is completed in less than 100 minutes without the use of ammonium hydroxide. The emulsions formed are suitable for x-ray films and produce the image tone required by radiologists.

22 Claims, No Drawings

FORMATION OF TABULAR SILVER HALIDE EMULSIONS UTILIZING HIGH PH DIGESTION

TECHNICAL FIELD

This invention relates to a process for preparing photographic emulsions containing tabular silver halide grains. It more particularly relates to a process for preparing photographic emulsions at high pH.

BACKGROUND ART

Tabular silver halide grains, their preparation and use in photographic emulsions are widely known. They have been extensively studied in the literature since photographic emulsions containing these grains appeared to offer some significant advantages over photographic emulsions containing round or globular grains (e.g., splash prepared types). Generally, tabular grains are large, flat silver halide grains that are prepared by employing long ripening times or by balanced double jet (BDJ) accelerated flow precipitation methods. Commercial emulsions using tabular grains are conventionally made by using a BDJ process. The tabular grains usually have triangular or hexagonal parallel crystal faces, each of which is usually larger than any other crystal face of the grain and are conventionally defined by their aspect ratio (AR) which is the ratio of the diameter of the grain to the thickness. Tabular grains of varying thicknesses and AR's have been found to be useful in photographic systems. Large diameter high aspect ratio grains, e.g., at least 8:1, have diameters of at least 0.6 μm and thicknesses of less than 0.3 μm. These larger tabular grains have certain commercial advantages now apparent to those of normal skill in the art. For example, they have a larger surface area and, thus, can accept more sensitizing dye. Since these tabular grains usually are dye sensitized when emulsions using such tabular grains are present in medical x-ray elements, an increase in sharpness can result. In addition, since the tabular grains normally lie flat when coated from an emulsion on a support, the covering power is usually greater and, thus, the emulsions can be coated at a lower coating weight and are, therefore, less costly.

The tabular grains have found wide use in full color, black-and-white, and x-ray films. However, in order to be successfully used in x-ray films, it is necessary that the tabular grain containing x-ray films have the same image tone as prior x-ray films. This is necessary as radiologists are used to this tone and demand that the tone remain the same in order that they may successfully read x-ray photographs in the same way they have in the past. In order to form T-grains satisfactory for x-ray films, it is necessary that they have a certain thickness and equivalent circular diameter range. The forming of grains within the preferred range has required long formation times, as well as the use of difficult to control materials. Nottorf U.S. Pat. No. 4,722,886 discloses the formation of silver halide materials suitable for use in x-ray film. As disclosed there, the process is performed with the pH of the digestion solution raised by the addition of ammonium hydroxide as a solvent. However, the use of ammonium hydroxide as a solvent sometimes lead the R-typing problem causing fog. Additionally, the use of ammonium hydroxide is difficult to control as the material is volatile and evaporates. Further, use of ammonium hydroxide requires a high amount of addition to raise the pH and results in problems with a effluent discharge as ammonium hydroxide is difficult to dispose of without special treatment.

There remains a need for a method of forming tabular silver halide emulsions at increased speed without problems of volatility of the base or difficulties in waste water disposal.

DISCLOSURE OF THE INVENTION

An object of the invention is to overcome disadvantages of the prior processes.

Another object is to provide improved photographic emulsions.

A further object is to provide shortened time for gelatin emulsion formation.

These and other objects of the invention are generally accomplished by providing a tabular silver halide emulsion formation process in which the pH is adjusted to greater than 9 by the addition of an alkali base after nucleation and prior to digesting to form uniform nucleated silver bromide particles. In a particularly preferred process the emulsion is adjusted to pH greater than 9 by the use of sodium hydroxide and digestion takes place in between 3 and 7 minutes and the emulsion making is completed in less than 100 minutes without the use of ammonium hydroxide. The emulsions formed are suitable for x-ray films and produce the image tone required by radiologists.

MODES FOR CARRYING OUT THE INVENTION

The invention has numerous advantages over the prior practices. The invention does not require the use of ammonium hydroxide to raise pH. The use of ammonium hydroxide tends to be difficult to control as the ammonium hydroxide evaporates rapidly changing the pH. Further, the ammonium hydroxide not being as strong a base as sodium hydroxide requires a greater amount of addition, increasing costs, as well as creating increased effluent cost as the effluent from ammonium hydroxide requires additional treatment beyond effluent of alkali hydroxide. The alkali bases of the invention are easier to control and m:re rapid in action during silver halide nucleation, thereby allowing shorter formation times. The lack of volatility of sodium hydroxide allows a consistent pH and further leads to less variation in the emulsion particles and greater monodispersity.

Prior to the present invention it was believed that high pH for emulsion formation tended to fog the grains. However, it has been surprisingly found that with T-grains precipitated with a high solution bromide concentration (about 0.01 molar), high bromide content and formed in high pH using alkali hydroxides do not exhibit fogging. The use of high pH to aid in digestion with formation of thick tabular crystals, suitable for x-ray film, in a rapid manner, without the presence of ammonium ion, was not recognized in the art.

In performing the process of the invention an emulsion of a bromide containing silver halide is formed. It may be silver bromide or silver chlorobromide and/or silver iodobromide. The nucleated emulsion is treated with an alkali base, preferably sodium hydroxide, and allowed to digest without addition of further silver or halogen ions. During digestion, material dissolves off the edge of the grains and deposits on the faces causing somewhat thicker tabular grains. Further, fine grain components are lost by transfer to the larger components in a process commonly referred to as "ripening".

The pH of the silver halide emulsion during ripening definitely is any pH above about 9. Suitable ranges have been found to be between about 9 and about 13. Preferred range have been found to be a pH of between about 9 and about 11 for most uniform grain formation with the desired thickness.

The digest time at high pH after nucleation may be any amount that produces the desired particles. Typically the digest time is between about 0.5 minutes and about 40 minutes. A preferred range has been found to be between about 1 and about 20 minutes to produce dispersions having large percentage of particles of the desired thickness and diameter. A most preferred range has been found to be between about 3 and about 7 minutes at a temperature of about 60° C. to about 80° C. for production of the highest percentage of particles in the desired thickness and diameter range.

The percentage of silver added in the nucleation phase prior to pH adjustment in the emulsion during digestion at high pH typically is between about 0.1 and about 20% of total silver to be formed. A preferred range of silver has been found to be between about 0.3 and about 12 percent of total silver to be added for efficient formation of particles of the desired properties. The most preferred percent of silver has been found to be about 0.6 to about 2.7 percent by weight of silver, as this results in a large percentage of particles in the desired thickness and diameter ranges.

The weight percent gel present in the reaction vessel during the digestion at high pH may be an amount that produces the desired particles. Typical of a percentage of gel that is suitable is between about 0.5 and about 20 percent by weight of the total solution. A preferred amount of gel is between about 1.5 and about 12 percent. The most preferred amount of gel has been found to be between about 2.5 and 7 for formation of grains with the desired dimensions.

The base utilized to produce the pH of greater than 9 may be any suitable alkali base. Typical of such bases are lithium hydroxide, sodium methacylicate, trisodium phosphate, sodium carbonate, and beryrilium hydroxide. Preferred alkali bases have been found to be sodium hydroxide and potassium hydroxide, as this does not introduce an undesirable salt into the emulsion solution, is not volatile, and is low in cost.

The tabular grain emulsions formed by the invention are such that at least 80 percent of the Projected area is made up of tabular crystals having a thickness greater than 0.1 micron. It is suitable that at least 80 percent of the projected area of the emulsion is made up of crystals having a thickness between about 0.1 and about 0.5 microns. It is preferred that at least 80 percent of the projected area of the emulsion is made up of crystals having a thickness preferred range between about 0.1 and about 0.3 microns for the desired x-ray tone.

The tabular emulsions of the invention generally have tabular grains of equivalent circular diameter between about 0.3 and 10 microns for the tabular grains of the invention. The preferred equivalent circular diameter is between about 0.5 and 5 microns for the 80 percent of the emulsion having a thickness greater than 0.1 micron. Measurements of the equivalent circular diameter and thickness are made by shadowed electron micrographs of emulsion samples.

After ripening, the solution containing the nucleated silver halide is adjusted to an acid pH by addition of an acid such as nitric acid. After adjustment to the acid pH, the addition of silver nitrate and the halide salt is begun until a grain of desired size is completed. Generally the halide and silver are added with an accelerated flow. Preferably at the end the last about 10% of silver is added with a decelerating flow and a declining bromide solution content.

After the silver halide emulsion is formed, it may be washed by known techniques such as coagulation, ion exchange, ultrafiltration, or noodling to remove excess nitrate and sodium ions. After washing to remove unwanted ions, the gelatin emulsion of silver halide particles is suitable for use in film. The silver halide formed by the present invention is particularly suitable for use in x-ray film as it Produces the somewhat thicker particles that give the image tone preferred by radiologists. The technique of the invention also is suitable for use in producing tabular silver halide grains for other photographic processes including color, negative and transparency film, and black-and-white negative film.

It is preferred that the pBr of the emulsion during ripening and growth stage be well above the pBr of the reaction vessel during nucleation.

Modyifying compounds can be present during silver bromide and silver bromoiodide precipitation. Such compounds can be initially in the reaction vessel or can be added along with one or more of the salts according to conventional procedures. Modifying compounds such as compounds of sulfur, selenium, and gold, as well as other modifying compounds, are disclosed in *Research Disclosure* 22534, Jan. 1983.

Vehicles, which include both binders and peptizers, can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives, and the preferred gelatin derived from cattle bone, hide, or pigskin. Such vehicles are well known and are also disclosed in the Research Disclosures above set forth.

The silver bromide grains of the present invention are preferably washed to remove soluble salts. Conventional washing procedures, such as those disclosed in *Research Disclosure* 17643, Vol. 176, Dec. 1978, II. herein incorporated by reference are contemplated.

Photographic emulsions can contain brighteners, antifoggants, stabilizers, scattering absorbing materials, hardeners, coating aids, plasticizers, lubricants, and matting agents such as described in Item 17643, paragraphs 5, 6, 7, 8, 10, 11, 12, and 16. Conventional photographic supports also can be employed and are described in paragraph 17 of Item 14643.

EXAMPLES

The invention can be better appreciated by reference to the following specific examples. In each of the examples the contents of the reaction vessel were stirred vigorously throughout the silver and halide salt additions and during ripening. The term "percent" means percent by weight unless otherwise indicated.

EXAMPLE 1

To 0.5 liters of a 0.6 percent aqueous gelatin solution containing 0.10M sodium bromide at 60° C., pH 4.0, was added with vigorous stirring 25 mL of 0.25M silver nitrate solution over a five-minute period (consuming 0.63 percent of the total silver used). The temperature was then raised to 70° C. over three minutes while adding 0.5 liters of aqueous gelatin solution (2.5 percent by weight). 8.75 mL of 2.5M sodium hydroxide was then added and held for 7 minutes. The pH that resulted was 10.5. 4.0M nitric acid was then added to reduce the pH to 4.0. A 2.5M sodium bromide solution and 2.5M silver nitrate solution were then added over 70 minutes by double jet addition utilizing accelerated flow (27.5 X increase in flow rates from start to finish) at pBr 1.42 at 70° C., consuming 89.37 percent of the total silver was used. A single jet addition of 2.5M silver nitrate utilizing decelerating flow (0.18 X decrease in flow rates from start to finish) for five minutes with increasing pBr of 1.42 to 2.41 at 70° C., consuming 10.00 percent of the total silver was then used. Approximately 1.0 moles of silver were used to prepare this emulsion.

EXAMPLE 2 (Control)

This emulsion was prepared identically to Example 1 except that 0.0 mL of 2.5M sodium hydroxide was added during the seven-minute hold period. pH that resulted was 5.2.

EXAMPLE 3

This emulsion was prepared identically to Example 1 except that 17.5 mL of 2.5M sodium hydroxide was added during the seven-minute hold period. pH that resulted was 10.8.

EXAMPLE 4

This emulsion was prepared identically to Example 1 except that 4.4 mL of 2.5M sodium hydroxide was added during the seven-minute hold period. pH that resulted was 10.0.

EXAMPLE 5

This emulsion was prepared identically to Example 1 except that 2.9 mL of 2.5M sodium hydroxide was added during the seven-minute hold period. pH that resulted was 9.5.

EXAMPLE 6

To 0.5 liters of a 0.6 percent gelatin solution containing 0.10M sodium bromide at 60° C., pH 4.0, was added with vigorous stirring 25 mL of 0.69M silver nitrate solution over a five-minute period (consuming 1.73 percent of the total silver used). The temperature was then raised to 70° C. over three minutes while adding 0.5 liters of aqueous gelatin and ammonium sulfate solution (4.7 percent by weight of gelatin and 0.42 percent ammonium sulfate). 16.5 mL of 2.5M sodium hydroxide was then added and held for five minutes. The pH that resulted was 9.5. 4.0M nitric acid was then added to reduce the pH to 4.0. A 2.5m sodium bromide solution and 2.5M silver nitrate solution were then added over 60.3 minutes by double jet addition utilizing accelerated flow (17.4 X increase in flow rates from start to finish) at pBr 1.42 at 70° C., consuming 88.27 percent of the total silver was used. A single jet addition of 2.5M silver nitrate utilizing decelerating flow (0.18 X decrease in flow rates from start to finish) for five minutes with increasing pBr of 1.42 to 2.41 at 70° C., consuming 10.00 percent of the total silver was then used. Approximately 1.0 moles of silver were used to prepare this emulsion.

EXAMPLE 7

This emulsion was prepared identically to Example 6 except that 30.1 mL of 2.5M sodium hydroxide was added during the five-minute hold period. pH that resulted was 11.0.

EXAMPLE 8 (Control)

This emulsion was prepared identically to Example 6 except that 7.6 mL of 2.5M sodium hydroxide was added during the five-minute hold period. pH that resulted was 8.0.

The characteristics of the emulsions of Examples 1–8 are summarized in Table I below. Consideration of control Examples 2 and 8 with the Examples of the invention clearly shows the success of the high pH of the invention in producing thick tabular grains of the type desired for x-ray use. Examples 6, 7, and 8 further illustrate that the high pH process of the invention produces the desired thick silver halide grains even when ammonia is present. In contrast the control of Example 8 in the ammonia did not produce thick particles.

TABLE I

| Example Emulsion | Mean Proj. Area | pH | Mean ECD (μm) | Thickness (μm) |
|---|---|---|---|---|
| 2 (Control) | 11.1 | 5.2 | 3.8 | .09 |
| 5 | 9.8 | 9.5 | 3.5 | .11 |
| 4 | 8.3 | 10.0 | 3.3 | .11 |
| 1 | 7.4 | 10.5 | 3.1 | .13 |
| 3 | 7.7 | 10.8 | 3.1 | .15 |
| 6 | 5.31 | 9.5 | 2.6 | 0.13 |
| 7 | 4.60 | 11.0 | 2.4 | 0.16 |
| 8 (Control) | 6.79 | 8.0 | 2.9 | 0.09 |

The invention has been described in detail with particular reference to preferred embodiments thereof, but it will be understood that variations and modifications can be effected within the spirit and scope of the invention.

We claim:

1. A method of forming silver halide emulsions comprising combining silver nitrate and sodium bromide in a gelatin solution so as to nucleate silver bromide particles, adding sodium hydroxide to adjust the pH to greater than about 9, allowing digestion of the nucleated particles, adjusting the pH to below 7 by acid addition, and adding silver nitrate and sodium halide to grow the nucleated particles.

2. The method of claim 1 wherein said pH is between about 9 and about 11.

3. The method of claim 1 wherein said digesting is carried out for between about 0.5 and about 40 minutes.

4. The method of claim 1 wherein said digesting is for between about three and about seven minutes.

5. The method of claim 1 wherein after digesting the pH is lowered by the addition of acid.

6. The method of claim 1 wherein between about 0.1 and about 20 percent of the total silver to be used is present at digestion.

7. The method of claim 1 wherein said silver halide particles comprise silver chlorobromide or silver iodobromide.

8. The process of claim 1 wherein digestion comprises between about 1 and about 20 minutes.

9. The process of claim 1 wherein the particles produced have a thickness of greater than 0.1 μm and a equivalent circular diameter of between about 0.3 and 10 microns.

10. The process of claim 9 wherein said process is completed in less than 100 minutes.

11. The process of claim 1 wherein said digestion comprises between about three and about seven minutes at a pH of between about 9 and about 11.

12. A method of forming silver halide emulsions comprising combining silver nitrate and sodium bromide in a gelatin solution so as to nucleate silver bromide particles, adding potassium hydroxide to adjust the pH to greater than about 9, allowing digestion of the nucleated particles, adjusting the pH to below 7 by acid addition, and adding silver nitrate and sodium halide to grow the nucleated particles.

13. The process of claim 12 wherein digestion comprises between about 1 and about 20 minutes.

14. The process of claim 12 wherein the particles produced have a thickness of greater than 0.1 μm and a equivalent circular diameter of between about 0.3 and 10 microns.

15. The process of claim 14 wherein said process is completed in less than 100 minutes.

16. The process of claim 12 wherein said digestion comprises between about three and about seven minutes at a pH of between about 9 and about 11.

17. The method of claim 12 wherein said pH is between about 9 and about 11.

18. The method of claim 12 wherein said digesting is carried out for between about 0.5 and about 40 minutes.

19. The method of claim 12 wherein said digesting is for between about three and about seven minutes.

20. The method of claim 12 wherein after digesting the pH is lowered by the addition of acid.

21. The method of claim 12 wherein between about 0.1 and about 20 percent of the total silver to be used is present at digestion.

22. The method of claim 12 wherein said silver halide particles comprise silver chlorobromide or silver iodobromide.

* * * * *